US005507438A

United States Patent [19]

Thomas et al.

[11] Patent Number: 5,507,438

[45] Date of Patent: Apr. 16, 1996

[54] FUEL GAS AND OXYGEN MIXER FOR CUTTING TORCHES

[75] Inventors: Carolyn E. Thomas, Cumming; David W. Gailey, Lula; Loren C. Smith, Ganesville, all of Ga.

[73] Assignee: The Lincoln Electric Company, Cleveland, Ohio

[21] Appl. No.: 287,516

[22] Filed: Aug. 8, 1994

[51] Int. Cl.[6] ..... B05B 7/12; F23D 11/40

[52] U.S. Cl. ..... 239/413; 239/419; 239/422; 431/346

[58] Field of Search ..... 239/416.2, 414, 239/413, 407, 419, 422, 427, 428; 431/346

[56] References Cited

U.S. PATENT DOCUMENTS

| | | | |
|---|---|---|---|
| 1,328,329 | 1/1920 | Johnson | 239/416.2 |
| 1,480,310 | 1/1924 | Smith | 239/419 X |
| 1,549,420 | 8/1925 | Hofstetter | 239/414 |
| 1,773,418 | 8/1930 | Wilson et al. | 239/416.2 X |
| 2,080,396 | 5/1937 | Campbell, Jr. | 239/419 X |
| 2,614,616 | 10/1952 | Villoresi, Jr. | 431/346 X |
| 3,255,803 | 6/1966 | Hach et al. | 431/346 X |
| 3,746,500 | 7/1973 | Hughey | 431/346 |
| 4,067,190 | 1/1978 | Hamm et al. | 431/346 X |
| 5,407,348 | 4/1995 | Mims et al. | 431/346 |

*Primary Examiner*—Andres Kashnikow
*Assistant Examiner*—Lesley D. Morris
*Attorney, Agent, or Firm*—Vickers, Daniels & Young

[57] ABSTRACT

A fuel gas and oxygen mixer for a gas torch comprises a tubular body having a mixing passage extending therethrough and having an upstream end connected to sources of a fuel gas and oxygen and a downstream end for delivering a mixture of the fuel gas and oxygen to a torch tip. The fuel gas is axially supplied to the upstream end of the mixer, and the oxygen flows along the outer surface of the body in the upstream direction from a point adjacent the downstream end of the body and then into the mixing passage through radial ports adjacent to the upstream end of the body. The counter flow of oxygen is through a passageway which provides for cooling of the mixer during normal operation of the torch and for the quenching of reversely flowing hot gases during a back fire.

19 Claims, 4 Drawing Sheets

FUEL GAS AND OXYGEN MIXER FOR CUTTING TORCHES

BACKGROUND OF THE INVENTION

This invention relates to the art of gas burning torches and more particularly to an improved fuel gas and oxygen mixer for a cutting torch.

Fuel gas-oxygen cutting torches are of course well known and generally comprise a torch head having outlet passages communicating with a torch tip or nozzle through which a combustible gaseous mixture flows and is ignited and directed toward a workpiece. The torch further includes fuel gas and oxygen supply lines connected to corresponding sources of fuel gas and oxygen, and valves for controlling the flow of fuel gas and oxygen to the torch head. Such torches have preheat and cutting modes of operation. In the preheat mode, the fuel gas and oxygen are combined in a mixer to provide a combustible mixture which flows to a torch head outlet and nozzle and which mixture is ignited to form a preheat flame which is used to heat a workpiece to a temperature which will support combustion. In the cutting mode, cutting oxygen is supplied to the torch head and nozzle separate from the preheat combustible mixture to flow from the nozzle to cut the heated workpiece.

It will of course be appreciated that the function of the fuel gas-oxygen mixer is to mix the fuel gas and oxygen components separately supplied thereto and to deliver the mixture to the torch head outlet and tip. Further, the mixer must supply a uniform mixture of fuel gas and oxygen to the point of combustion in order to achieve uniform combustion efficiency throughout the flame resulting from igniting the combustible mixture, and the fuel gas and oxygen flow rates to and through the mixer must be adequate for the required flow rates for a given torch at the available fuel gas and oxygen supply pressures. A further performance requirement with regard to the fuel gas-oxygen mixer is resistance to flashback. In this respect, it is commonplace during use of such a torch for a backfire to occur if, for example, the torch tip contacts the workpiece causing an explosion inside the torch between the point of mixing of the fuel gas and oxygen and the point of combustion at the torch tip. If such backfiring results in sustained combustion inside the torch the latter condition is defined as flashback, and flashback can quickly destroy a torch. Accordingly, the fuel gas-oxygen mixer must be capable of handling a considerable number of backfires in rapid succession without the occurrence of flashback.

When a backfire occurs, some of the exploded gases exit in the normal direction of flow through the torch tip and the remainder of the gases exit in the reverse direction through the fuel gas and oxygen inlet passages to the mixer. In order to avoid flashback when the reverse flow stops and the fuel gas and oxygen re-enter the mixer through the inlet passages, the area between the point of mixing in the mixer and the flame holes at the torch tip must either be free of a combustible mixture or free of a source of ignition. The latter conditions are influenced in part by factors directly related with the torch tip, torch and inlet gas pressures and in part by factors directly related to the mixer structure. With regard in particular to the latter, these factors include the area of the oxygen inlet passage or passages into the mixer, the cross-sectional, length and volume dimensions of the passage in which the gases are mixed, and the ability to achieve cooling with respect to the mixer during normal operation and quenching with respect to the reverse flow of hot gases through the mixer during backfire. Mixer designs heretofore available are limited with respect to the length of the mixer and mixing passage as well as the configuration of the gas flow paths thereto and therethrough, whereby protection against flashback is less than desirable.

SUMMARY OF THE INVENTION

In accordance with the present invention, a fuel gas-oxygen mixer for a gas burning torch is provided which optimizes protection against flashback. In accordance with one aspect of the invention, the mixer is structurally associated with one of the fuel gas and oxygen supply passageways to the torch head in a manner whereby the length of the mixer is limited only by the length of the supply passageway. This advantageously enables the length, diameter and volume of the mixing passage through the mixer to be widely varied so as to obtain optimum protection against flashback in conjunction with given values for the factors referred to above which relate directly to the torch tip, torch and supply gas pressures.

In accordance with another aspect of the invention, the supply of fuel gas and oxygen to the inlet end of the mixer is such that one of the gases flows along the outer side of the mixer in a direction opposite to that of the flow of the mixed gases through the mixing passage of the mixer, thus to cool the mixer during normal operation and to provide a quenching passageway for the reverse flow of hot gases through the mixer inlet during a backfire. The cooling of the mixer during normal operation together with quenching of the hot gases during backfire optimizes the resistance to flashback.

In accordance with yet another aspect of the invention, incorporation of the mixer in one of the gas supply passageways so as to enable the mixer to be of any desired length together with the counter flow of the other one of the gases relative to the outer side of the mixer advantageously provides for the inlet openings into the mixing passage for the fuel gas and oxygen to be of a number, size and location relative to one another to provide for both optimum mixing of the two gases and optimum resistance to flashback.

It is accordingly an outstanding object of the present invention to provide an improved fuel gas and oxygen mixer for a gas burning torch.

Another object is the provision of a mixer of the foregoing character having improved resistance to flashback.

A further object is the provision of a mixer of the foregoing character which is incorporated with torch head and gas supply passageway components of the torch such that the length of the mixer is limited only by the length of the gas passageway.

Still a further object is the provision of a mixer of the foregoing character having a mixing passageway therethrough and a cooling and quenching passageway thereabout which provides for cooling the mixer during the normal flow of gases therethrough to the torch head and tip and quenching of reversely flowing hot gases during a backfire.

Still another object is the provision of a mixer of the foregoing character wherein the flow of one of the fuel gas and oxygen into the inlet end of the mixing passage through the mixer is along the outside of the mixer and in the direction opposite to the direction of flow of the mixed gases through the mixing passageway.

Yet a further object is the provision of a mixer of the foregoing character which is structured and structurally interrelated with the torch head and fuel gas supply passageway to the head such that the dimensions of the component parts and the dimensional interrelationships therebetween including the number, size and location of inlet ports for the fuel gas and oxygen enable optimizing mixing of the gases and resistance to flash back during use of the torch.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
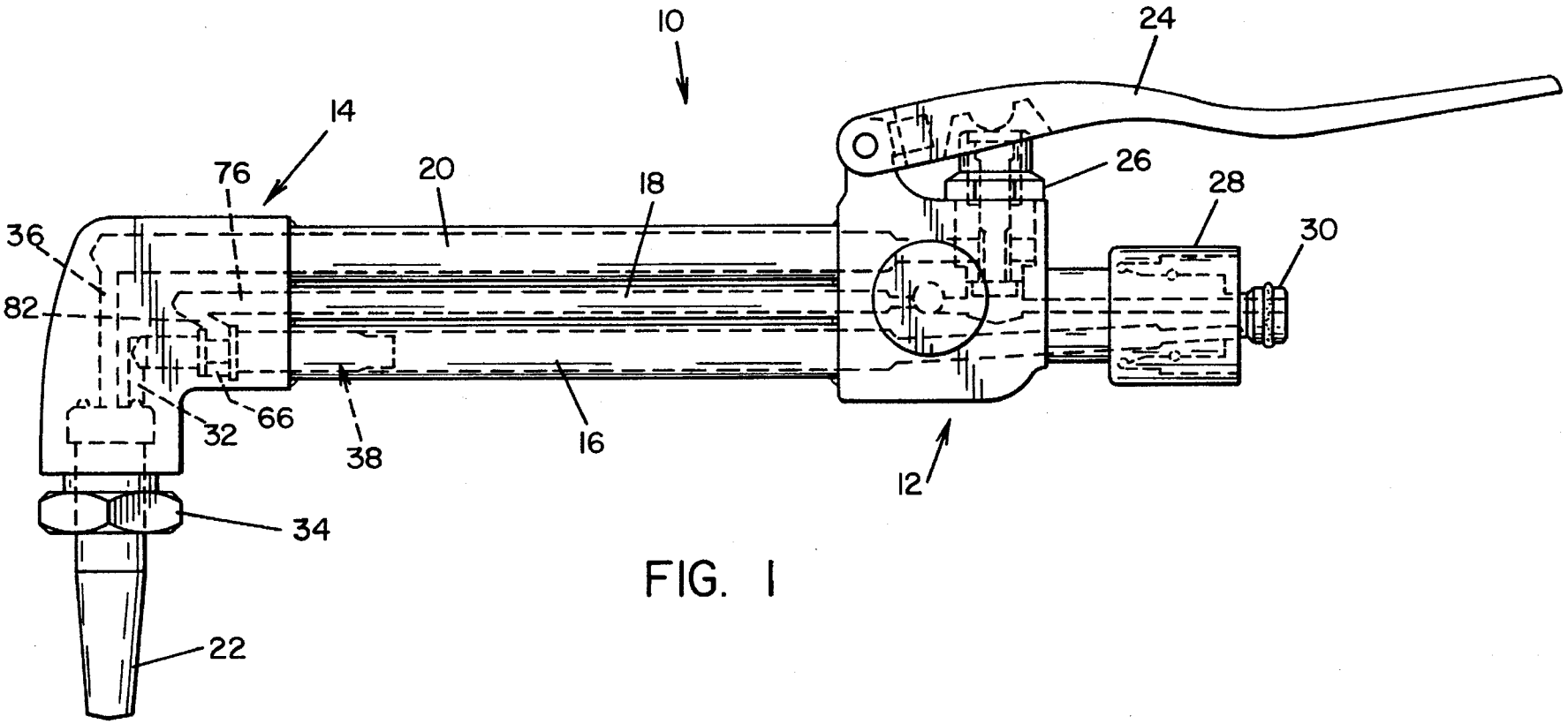
FIG. 1 is an elevation view of a gas burning torch incorporating a mixer in accordance with the present invention.

Referring now in greater detail to the drawings, wherein the showings are for the purpose of illustrating a preferred embodiment of the invention only and not for limiting the invention, a gas burning torch 10 is illustrated in FIG. 1 which includes a valve housing 12, and a torch head 14 connected to the valve housing by a fuel gas supply tube 16, a preheat oxygen supply tube 18 and a cutting oxygen supply tube 20. The torch further includes a torch tip 22 and a valve operating lever 24 pivotally mounted on housing 12 for controlling the actuation of a valve 26 and thus the flow of cutting oxygen through tube 20 to torch head 14 and tip 22. Valve housing 12 includes coupling components 28 and 30 for connecting the torch to supplies of a fuel gas and oxygen, respectively, and the flow of fuel gas to tube 16 and preheat oxygen to tube 18 is controlled by manually adjustable valves, not shown.

Figure 2:
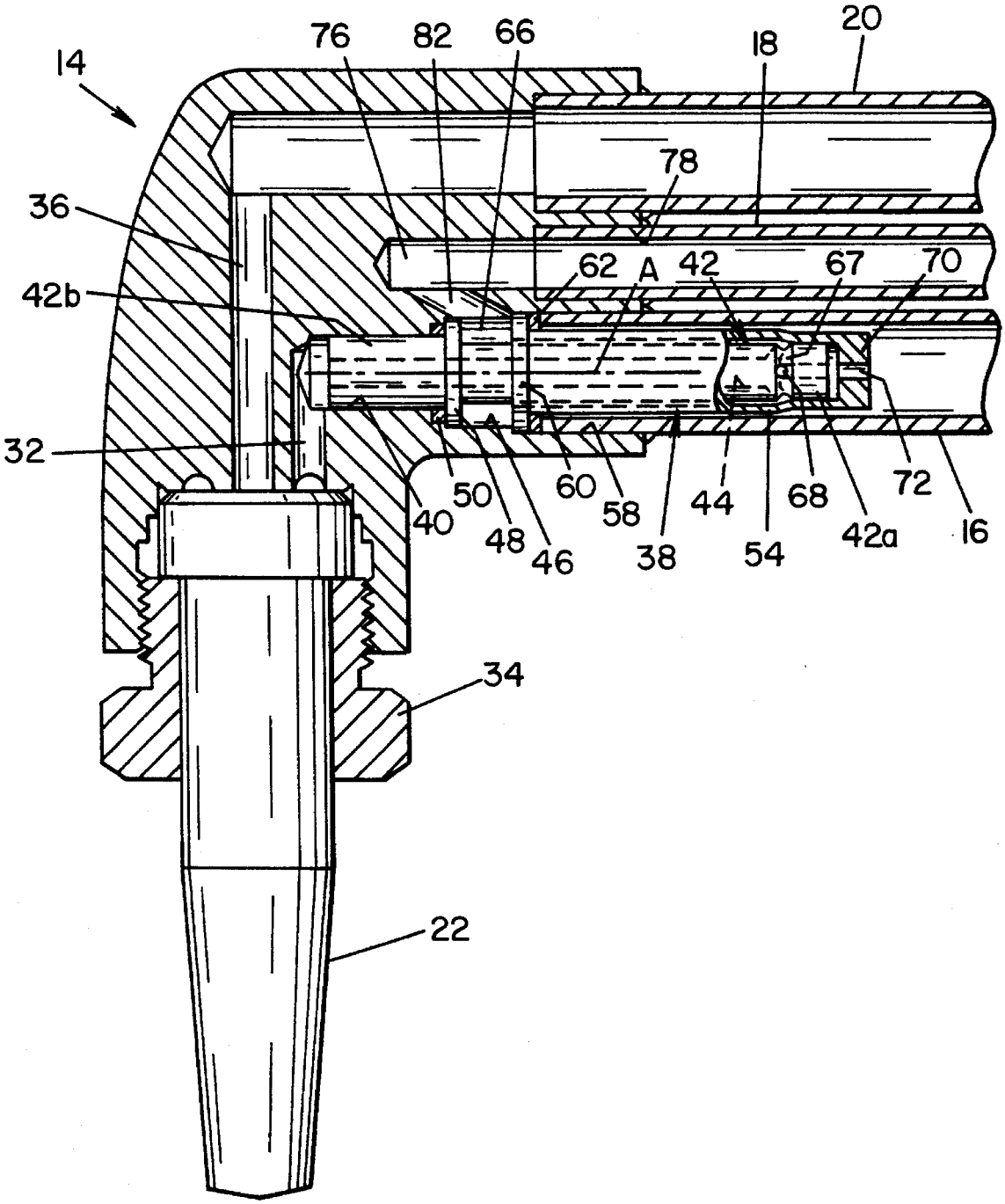
FIG. 2 is an enlarged sectional elevation view of the torch head, gas supply tubes and mixer of the torch illustrated in FIG. 1.
Figure 3:
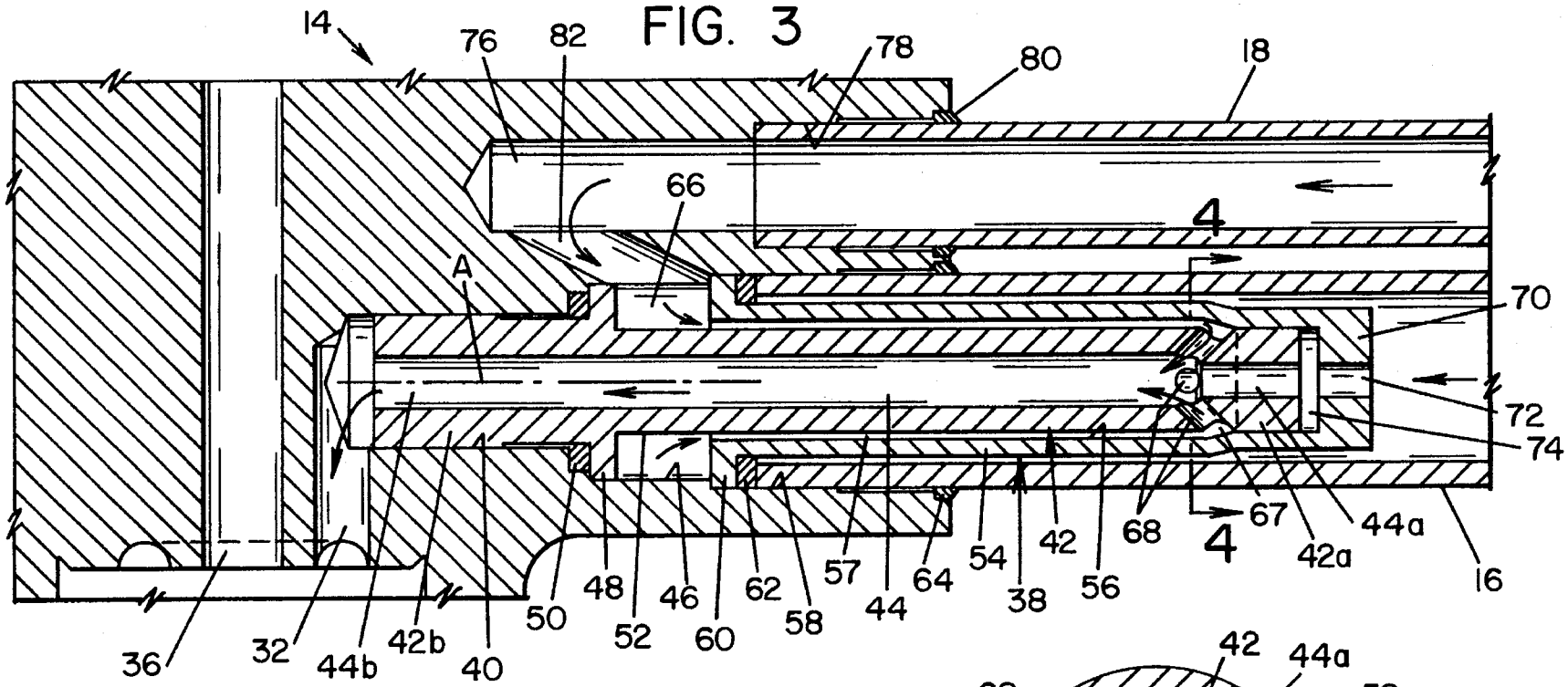
FIG. 3 is an enlarged sectional elevation view of the mixer.
Figure 4:
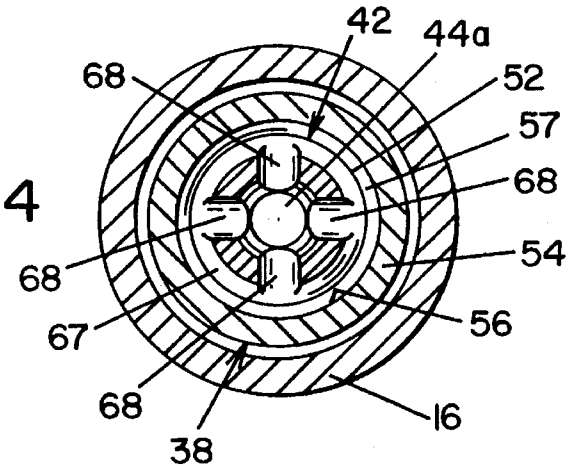
FIG. 4 is a cross-sectional elevation view of the mixer taken along line 4—4 in FIG. 3.

As best seen in FIGS. 2 and 3, and as will be described in greater detail hereinafter, torch head 14 includes an outlet 32 for delivering a combustible mixture of fuel gas and oxygen to the inner end of torch tip 22 which is secured to torch head 14 by means of a tip nut 34. Torch head 14 also includes an outlet 36 for delivering cutting oxygen to the torch tip. As is well known, and thus not shown, torch tip 22 has a passageway or passageways therethrough for delivering the combustible mixture to a combustion zone at the lower end of the torch tip for ignition, and a passageway for delivering cutting oxygen through the tip toward a workpiece to be cut.

In accordance with the present invention, a fuel gas and oxygen mixer 38 is mounted in torch head 14 and extends therefrom into fuel gas supply tube 16. More particularly in this respect, torch head 14 includes a first bore having an inner end portion 40 opening to outlet 32 which, preferably, is provide by two circular passageways which are parallel and adjacent diametrically opposite sides of bore portion 40. The first bore in torch head 14 has an axis A, and mixer 38 includes a tubular body 42 having a mixing passage 44 extending therethrough. Body 42 has upstream and downstream ends **42*a* and 42*b*, respectively, with respect to the direction of flow of gases through mixing passage 44 to outlet 32, and mixing passage 44 has corresponding upstream and downstream ends 44*a* and 44*b*. The first bore in torch head 14 further includes an intermediate portion 46 stepped radially outwardly relative to inner portion 40, and mixer body 42 includes a radially outwardly extending flange 48 spaced from downstream end 42*b* of the body and received in bore portion 46. Downstream end 42*b* of body 42 is received in bore portion 40, and the body is sealingly secured to torch head 14 by a silver brazed joint 50 between flange 48 and the shoulder between bore portions 40 and 46**.

Body 42 has a circular outer surface 52 between flange 48 and upstream end **42*a* thereof and, in the embodiment disclosed, mixer 38 further includes a circular sleeve 54 having an inner surface 56 surrounding and spaced radially outwardly of surface 52 to provide an annular oxygen inlet passageway 57 for the purpose set forth more fully hereinafter. The first bore in torch head 14 further includes a portion 58 stepped radially outwardly relative to bore portion 46, and sleeve 54 includes a radially outwardly extending circular flange 60 at the inner end thereof engaging against the shoulder between bore portions 46 and 58. Fuel gas supply tube 16 surrounds sleeve 54 in bore portion 58 and has an inner end adjacent flange 60, and sleeve 54 is sealingly secured to torch head 14 by a silver brazed joint 62 between flange 60 and the inner end of tube 16. Tube 16 is further sealed to torch head 14 by a silver brazed joint 64 at the outer end of bore portion 58. Flange 60 is axially spaced from flange 48 in the upstream direction with regard to body 42 to provide an annular oxygen inlet channel 66** between the flanges for the purpose set forth hereinafter.

Body 42 is provided adjacent upstream end **42*a* thereof with an annular recess 67 in outer surface 52 and pairs of diametrically opposed oxygen inlet ports 68 opening from recess 67 into mixing passage 44. Preferably, inlet ports 68 are inclined relative to axis A in the downstream direction relative to mixing passage 44. The outer end of sleeve 54 extends across recess 67 and thus the radially outer ends of ports 68 and is necked in to provide a press fit thereof with upstream end 42a of body 42. Preferably, sleeve 52 extends axially outwardly beyond upstream end 42*a* of body 42 and has an end wall 70 transverse to axis A and provided with a port 72 coaxial with upstream end 44*a* of mixing passage 44. The axial space 74 between end wall 70 and upstream end 42*a* of body 42** provides an expansion joint therebetween.

Torch head 14 includes a second bore having an inner portion 76 and an outer portion 78 which is stepped radially outwardly relative to bore portion 76 to receive preheat oxygen tube 18 which is sealingly secured to torch head 14 by a silver brazed joint 80. Bore portion 76 communicates with annular inlet channel 66 by way of a passage 82 therebetween and which passage, preferably, is inclined relative to axis A in the upstream direction with respect to body 42. Accordingly, it will be appreciated that preheat oxygen flows through tube 18 and passageway 82 to annular channel 66 in the directions of the arrows shown therein and then in the upstream direction along outer surface 52 of body 42 to recess 67 and inlet ports 68 and through ports 68 into mixing passage 44.

The annular oxygen inlet passageway 57 between outer surface 52 of body 42 and inner surface 56 of sleeve 54 has an entrance end at sleeve flange 60 and provides a cooling and quenching passageway for gases during use of the torch. In this respect, as will be appreciated from the foregoing description of the mixer, fuel gas flowing through tube 16 enters the mixer through port 72 and upstream end **44*a* of mixing passage 44, and preheat oxygen flowing through preheat oxygen tube 18 enters channel 66 between flanges 48 and 60 and then flows through the entrance end of inlet passageway 57 in the upstream direction relative to body 42 to recess 67 and inlet ports 68. The preheat oxygen then passes through ports 68 to commingle and mix with the fuel gas during flow of the two gases downstream through mixing passage 44 to torch head outlet 32. During normal operation of the torch in which the fuel gas and oxygen flow in the foregoing manner, the flow of preheat oxygen in the upstream direction along body 42 provides a cooling effect for the component parts of the mixer and, during a backfire and the reverse flow of hot gases through mixing passage 44, annular passage 57 provides a quenching passage for a portion of the hot gases flowing in the reverse direction through inlet ports 68. The reverse flow of hot gases into annular passageway 57 for quenching is enhanced by the direction of incline of inlet ports 68 so as to optimize the quenching effect. Furthermore, the ability to cool the component parts of the mixer during normal operation of the torch, together with the length of mixing passage 44 and quenching of reversely flowing hot gases during a backfire optimize protection against flashback as a result of a rapid succession of backfires. During a backfire, a portion of the reversely flowing hot gases will exit mixing chamber 44 through inlet end 44*a* thereof and port 72 in sleeve flange 70**.

As will be appreciated from FIGS. 2 and 3, flange 48 of body 42 is closer to the downstream end of the body than to the upstream end, whereby the preheat oxygen inlet channel 66 is likewise located closer to the downstream end so as to provide for the cooling and quenching passageway to have an axial length which optimizes achieving the cooling and quenching functions. Further in this respect, as will be appreciated from FIGS. 1 and 2, mixer 38 can be of any desired axial length limited only be the length of fuel gas tube 16, thus further providing for sizing the mixer to achieve optimum resistance to flashback in connection with other design and operating parameters of the torch.

Figure 5:
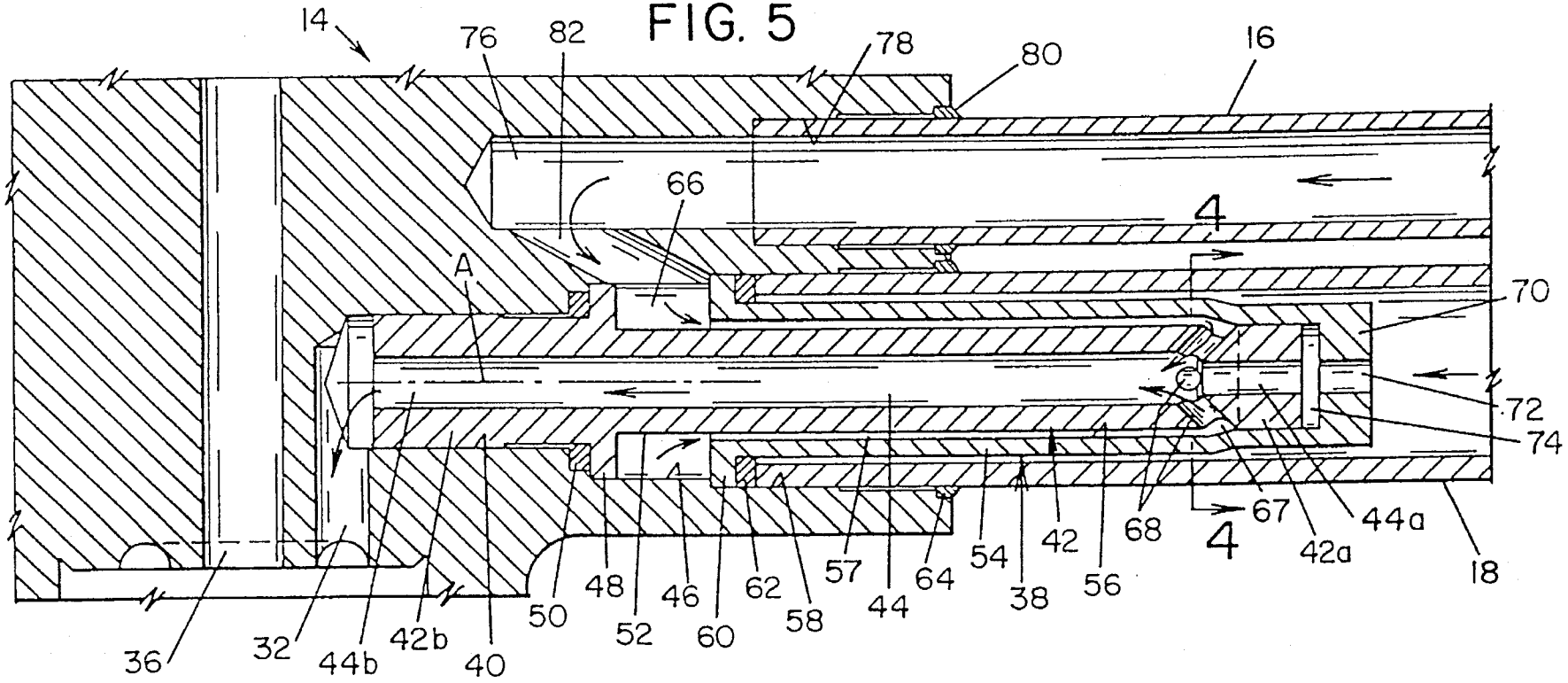
FIG. 5 is an enlarged sectional elevation view of an alternative embodiment of the mixer.

While considerable emphasis has been placed herein on the structure and structural interrelationships between the component parts of a preferred embodiment of the mixer, it will be appreciated that other embodiments of the invention can be made and that many changes can be made in the preferred embodiment without departing from the principals of the invention. In this respect, for example, an arrangement could be devised for providing the mixer to be associated with preheat oxygen tube 18 rather than the fuel gas tube and, in such arrangement, to provide for the fuel gas to flow relative to the mixer through the passageway providing the cooling and quenching functions as shown in FIG. 5. It will likewise be appreciated that the annular passageway surrounding the outer surface of the mixer body to achieve the cooling and quenching functions can be provided other than by a sleeve member separate from the body and structurally associated with the inlet end of the body as disclosed herein. In this respect, for example, the annular passageway could be defined by the outer surface of the mixer body and the inner surface of the gas supply tube into which the body extends with the sealed relationship at the upstream end of the body being provided by, for example, crimping the gas supply tube thereabout. It is also possible to modify the mixer to provide an injector concept wherein, in the embodiment disclosed, the oxygen enters the mixer at a high velocity and aspirates the fuel which could then be at a lower pressure. These and other modifications of the preferred embodiment as well as other embodiments of the invention will be obvious and suggested to those skilled in the art from the foregoing disclosure, whereby it is to be distinctly understood that the foregoing descriptive matter is to be interpreted merely as illustrative of the present invention and not as a limitation.

Having thus described the invention it is claimed:

1. In a gas torch comprising a torch head having an outlet, mixing means for delivering a mixture of a fuel gas and oxygen to said outlet, fuel gas passageway means for delivering a fuel gas to said mixing means, and oxygen passageway means for delivering oxygen to said mixing means, the improvement comprising: said mixing means including body means having an axis and a mixing passage extending axially therethrough, said mixing passage having upstream and downstream ends, said upstream end communicating with one of said fuel gas passageway means and said oxygen passageway means and said downstream end communicating with said outlet, said body means having an outer surface and inlet port means between said outer surface and said mixing passage adjacent said upstream end thereof, and means for communicating the other of said fuel gas passageway means and said oxygen passageway means with said outer surface of said body means downstream from said inlet port means, whereby the corresponding one of said fuel gas and said oxygen flows upstream along said outer surface to said inlet port means and therethrough into said mixing passage, said means for communicating the other of said fuel gas passageway means and said oxygen passageway means with said outer surface of said body means comprises sleeve means surrounding and spaced from said outer surface to provide an annular passage for said corresponding one of said fuel gas and said oxygen to flow to said inlet port means, said sleeve means and said outer surface of said body means include means cooperating to provide an inlet passage to said annular passageway from said other of said fuel gas passageway means and said oxygen passageway means, and said sleeve means has an end and said cooperating means includes a first flange extending radially outwardly from said outer surface of said body means and a second flange extending radially outwardly of said sleeve means at said end thereof, said second flange being axially spaced from said first flange in the direction toward said upstream end of said mixing passage.

2. The improvement according to claim 1, wherein said outer surface of said body means has first and second ends corresponding respectively to said upstream and downstream ends of said mixing passage, said first flange being closer to said second end than to said first end.

3. The improvement according to claim 2, wherein said second flange is closer to said second end than to said first end.

4. The improvement according to claim 3, wherein said one of said fuel gas passageway means and said oxygen passageway means is said fuel gas passageway means.

5. In a gas torch comprising a torch head having an outlet, mixing means for delivering a mixture of a fuel gas and oxygen to said outlet, fuel gas passageway means for delivering a fuel gas to said mixing means, and oxygen passageway means for delivering oxygen to said mixing means, the improvement comprising; said mixing means including a cylindrical body having an axis, upstream and downstream ends and an axially extending cylindrical mixing passage therethrough between said ends and coaxial with said axis, said torch head having a first bore communicating with said outlet and receiving said downstream end of said body, said body having a cylindrical outer surface and a plurality of inlet ports opening radially therefrom into said mixing passage adjacent said upstream end, sleeve means coaxial with and surrounding said outer surface of said body and including a portion extending downstream from said upstream end of said body in spaced relationship with said outer surface and said inlet ports to provide an annular inlet passageway to said inlet ports having an entrance end in said first bore downstream from said ports, said fuel gas passageway means including a fuel gas tube coaxial with and surrounding said sleeve means and having an end received in said first bore and sealed with respect thereto, whereby fuel gas flowing through said fuel gas tube enters said mixing passage at said upstream end of said body and flows therethrough to said outlet, said oxygen passageway means including port means in said torch head communicating with said entrance end of said annular inlet passageway, whereby oxygen flowing through said oxygen passageway means enters said entrance end of said inlet passageway and flows upstream of said body to said inlet ports and through said ports to said mixing passage for flow therethrough and mixing with said fuel gas flowing therethrough.

6. The improvement according to claim 5, wherein said fuel gas and tube and said sleeve means are radially spaced to provide an annular chamber therebetween.

7. The improvement according to claim 5, wherein said inlet ports are inclined relative to said axis in the downstream direction relative to said body.

8. The improvement according to claim 5, wherein said sleeve means includes a sleeve flange in said first bore at said entrance end of said annular inlet passageway and said downstream end of said annular inlet passageway and said downstream end of said body includes a body flange in said first bore spaced downstream from said sleeve flange, said port means in said torch head opening into the space between said body and sleeve flanges.

9. The improvement according to claim 5, wherein said sleeve means sealingly engages said body upstream from said inlet ports and includes an underwall spaced upstream from said upstream end of said body, said end wall being transverse to said axis and having an opening therethrough for said fuel gas to flow into said mixing passage.

10. The improvement according to claim 5, wherein said inlet ports are inclined relative to said axis in the downstream direction relative to said body, and wherein said sleeve means sealingly engages said body upstream from said inlet ports and includes an end wall spaced upstream from said upstream end of said body, said end wall being transverse to said axis and having an opening therethrough for said fuel gas to flow into said mixing passage.

11. The improvement according to claim 10, wherein said sleeve means includes a sleeve flange in said first bore at said entrance end of said annular inlet passageway and said downstream end of said annular inlet passageway and said downstream end of said body includes a body flange in said first bore spaced downstream from said sleeve flange, said port means in said torch head opening into the space between said body and sleeve flanges.

12. The improvement according to claim 11, wherein said fuel gas and tube and said sleeve means are radially spaced to provide an annular chamber therebetween.

13. In a gas torch comprising a torch head having an outlet, mixing means for delivering a mixture of a fuel gas and oxygen to said outlet, fuel gas passageway means for delivering a fuel gas to said mixing means, and oxygen passageway means for delivering oxygen to said mixing means, the improvement comprising: said mixing means including body means having an axis and a mixing passage extending axially therethrough, said mixing passage having upstream and downstream ends, said upstream end communicating with one of said fuel gas passageway means and said oxygen passageway means and said downstream end communicating with said outlet, said body means having an outer surface and inlet port means between said outer surface and said mixing passage adjacent said upstream end thereof, and means for communicating the other of said fuel gas passageway means and said oxygen passageway means with said outer surface of said body means downstream from said inlet port means, whereby the corresponding one of said fuel gas and said oxygen flows upstream along said outer surface to said inlet port means and therethrough into said mixing passage, said inlet port means includes at least one inlet port inclined relative to said axis in the downstream direction relative to said body means.

14. The improvement according to claim 13, wherein said means for communicating the other of said fuel gas passageway means and said oxygen passageway means with said outer surface of said body means comprises sleeve means surrounding and spaced from said outer surface to provide an annular passage for said corresponding one of said fuel gas and said oxygen to flow to said inlet port means.

15. The improvement according to claim 14, wherein said sleeve means and said outer surface of said body means include means cooperating to provide an inlet passage to said annular passageway from said other of said fuel gas passageway means and said oxygen passageway means.

16. The improvement according to claim 13, wherein said fuel gas passageway means supplying fuel gas upstream from said inlet port means and said oxygen passage means supplying oxygen downstream from said inlet port means.

17. In a gas torch comprising a torch head having an outlet, mixing means for delivering a mixture of a fuel gas and oxygen to said outlet, fuel gas passageway means for delivering a fuel gas to said mixing means, and oxygen passageway means for delivering oxygen to said mixing means, the improvement comprising: said mixing means including body means having an axis and a mixing passage extending axially therethrough, said mixing passage having upstream and downstream ends, said upstream end communicating with one of said fuel gas passageway means and said oxygen passageway means and said downstream end communicating with said outlet, said body means having an outer surface and inlet port means between said outer surface and said mixing passage adjacent said upstream end thereof, and means for communicating the other of said fuel gas passageway means and said oxygen passageway means with said outer surface of said body means downstream from said inlet port means, whereby the corresponding one of said fuel gas and said oxygen flows upstream along said outer surface to said inlet port means and therethrough into said mixing passage, said inlet port means includes at least one inlet port inclined relative to said axis in the downstream direction relative to said body means, said means for communicating the other of said fuel gas passageway means and said oxygen passageway means with said outer surface of said body means comprising sleeve means surrounding and spaced from said outer surface to provide an annular passage for said corresponding one of said fuel gas and said oxygen to flow to said inlet port means, said sleeve means and said outer surface of said body means include means cooperating to provide an inlet passage to said annular passageway from said other of said fuel gas passageway means and said oxygen passageway means, said sleeve means having an end and said cooperating means including a first flange extending radially outwardly from said outer surface of said body means and a second flange extending radially outwardly of said sleeve means at said end thereof, said second flange being axially spaced from said first flange in the direction toward said upstream end of said mixing passage.

18. The improvement according to claim 17, wherein said outer surface of said body means has first and second ends corresponding respectively to said upstream and downstream ends of said mixing passage, said first flange being closer to said second end than to said first end.

19. The improvement according to claim 18, wherein said second flange is closer to said second end than to said first end.

* * * * *